United States Patent [19]

Grassl et al.

[11] Patent Number: 4,594,487

[45] Date of Patent: Jun. 10, 1986

[54] MOUNTING MEANS FOR PROXIMITY SENSING DEVICE

[75] Inventors: Roman Grassl; Thomas A. Craig, both of Menomonee Falls; Eric P. Weil, Milwaukee, all of Wis.

[73] Assignee: Galland Henning Nopak, Inc., Milwaukee, Wis.

[21] Appl. No.: 679,535

[22] Filed: Dec. 7, 1984

[51] Int. Cl.[4] ..... H01H 35/38

[52] U.S. Cl. ..... 200/82 E

[58] Field of Search ..... 335/205; 200/82 E; 91/1; 92/5 R

[56] References Cited

U.S. PATENT DOCUMENTS

| | | | |
|---|---|---|---|
| 2,187,115 | 1/1940 | Ellwood et al. | 335/152 |
| 2,462,571 | 2/1949 | Thompson et al. | 91/275 |
| 2,870,287 | 1/1954 | Corbitt et al. | 335/154 |
| 2,927,178 | 3/1960 | Nitsch | 335/154 |
| 3,160,836 | 7/1960 | Farley | 336/30 |
| 3,310,863 | 3/1967 | Ellwood et al. | 335/151 |
| 3,364,361 | 1/1968 | Burger | 92/5 R |
| 3,453,937 | 7/1969 | Haberman | 92/5 R |
| 3,524,634 | 8/1970 | Schmidt | 361/159 X |
| 3,639,868 | 2/1972 | Gasper et al. | 335/205 |
| 3,691,902 | 9/1972 | Lebzelter | 91/1 |
| 4,071,725 | 1/1978 | Smith et al. | 200/82 E |
| 4,086,456 | 4/1978 | Bone | 200/82 E |
| 4,161,659 | 7/1979 | Jacob | 335/205 X |
| 4,161,685 | 7/1979 | Jacob | 335/205 X |
| 4,176,586 | 12/1979 | Stoll et al. | 92/5 R |
| 4,230,023 | 10/1980 | Ward | 200/82 E |
| 4,316,145 | 2/1982 | Tann | 335/205 X |
| 4,419,646 | 12/1983 | Hermle | 335/205 X |

*Primary Examiner*—L. T. Hix

*Assistant Examiner*—Brian W. Brown

*Attorney, Agent, or Firm*—Robert C. Sullivan

[57] ABSTRACT

A mounting arrangement for supporting a proximity sensing means such as a reed type proximity switch contiguous the outer peripheral surface of a fluid power cylinder, in which said fluid power cylinder is of the type comprising a cylinder body and a piston axially movable in said cylinder body, and in which said fluid power cylinder includes a pair of oppositely disposed end closure members respectively positioned at each of the respective opposite ends of said cylinder body and tie rod means connecting said oppositely disposed end closure members. The mounting arrangement comprises a sensing means support device adapted to be detachably mounted on the fluid power cylinder. The sensing means support device comprises a clamp member for detachable connection to the tie rod means, and a swivel member pivotally supported by the clamp member, the swivel member being positional in overlying relation to a portion of the outer peripheral surface of the cylinder body when the sensing means support device is mounted on the fluid power cylinder. The swivel member is adapted to support a sensing device, such as a reed switch, contiguous the outer peripheral surface of the cylinder body. The reed switch is responsive to the presence of a magnetic field; and the piston which is movable in the cylinder has a permanent magnet mounted thereon. The clamp member is provided with a notched contour adapted to fit over tie rods of different diameters, and is also provided with a hook profile which adapts the clamp member to be easily moved to any desired adjusted position along the tie rod and to be tightened into engagement with the tie rod and with the outer surface of the fluid cylinder.

19 Claims, 4 Drawing Figures

MOUNTING MEANS FOR PROXIMITY SENSING DEVICE

BACKGROUND OF THE INVENTION

1. Field of the Invention

This invention relates to an improved mounting arrangement for a proximity sensing device or proximity switch and more particularly to an arrangement for mounting such a proximity sensing device with respect to the outer peripheral surface of a fluid power cylinder (i.e.—a linear actuator), whereby to sense the position of an axially movable piston within the cylinder. The proximity sensing device may be, but is not necessarily, of the magnetic reed type, for example, which is actuated by the presence of a magnet carried by the piston whose position within the cylinder is being detected.

2. Description of the Prior Art

It is well known in the prior art, in a broad sense, to detect the position of an axially movable piston within a fluid cylinder by mounting a proximity sensing device or proximity switch contiguous the outer surface of the cylinder, to sense the presence of the axially movable piston at a given location within the cylinder. The proximity sensing device may operate upon the magnetic principle, as in the case of a reed switch proximity sensing device, for example, which is actuated by the presence of a magnetic member or magnet carried by the movable piston within the cylinder.

It is also known in the prior art to provide a mounting arrangement for proximity switches for use with fluid cylinders in which the mounting arrangement cooperates in some manner with one or more of the tie-rods which extend between end closures at the opposite ends of the fluid cylinder. The following United States patents are examples of patents showing such a cooperative relation:

4,071,725—Smith et al
4,086,456—Bone
4,230,023—Ward

U.S. Pat. No. 3,639,868—Gaspar et al shows a mounting arrangement for a proximity sensing device or switch which is adapted for use on fluid power cylinders of different diameters. In the patent to Gasper et al, an arm which supports a proximity sensing device such as a magnetic reed switch contiguous the outer surface of a fluid cylinder such as an air cylinder is provided with a specially contoured opposite end portion which cooperates with a slotted track mounted on the outer surface of the fluid cylinder in such manner that the arm supporting the proximity device may be adjusted to different angular positions to accommodate itself to fluid cylinders of different diameters.

The following U.S. patents also disclose various types of proximity sensing devices or the like for use with fluid cylinders or the like:

2,462,571—Thompson et al
3,160,836—Farley
3,364,361—Burger
3,453,937—Haberman
3,524,634—Schmidt
3,691,902—Lebzelter
4,161,659—Jacob
4,161,685—Jacob
4,176,586—Stoll et al
4,316,145—Tann
4,419,646—Hermle

OBJECTS OF THE INVENTION

Accordingly, it is an object of the present invention to provide an improved arrangement for mounting a proximity sensing device on a fluid power cylinder.

It is a further object of the invention to provide an improved mounting arrangement for a proximity sensing device or switch in which the mounting means is adapted for use with fluid cylinders of the type having axially extending tie rods secured to oppositely disposed end closures of the fluid cylinder.

It is still a further object of the invention to provide an improved mounting arrangement for a proximity sensing switch for use with fluid cylinders or the like of the type in which the fluid cylinder is provided with tie rods extending between end closures located at the opposite ends of the fluid cylinder, and in which the mounting device is adapted to be mounted on cylinders having tie rods of different diameters.

It is still a further object of the invention to provide an improved mounting arrangement for proximity sensing devices for use with fluid operated cylinders of the type provided with at least one tie rod extending axially of the cylinder between oppositely disposed end closures, and in which the same mounting means is adapted to be mounted interchangeably on fluid cylinders having different outer diameters.

It is still a further object of the invention to provide a clamp arrangement for supporting a proximity sensing switch contiguous the outer surface of a fluid power cylinder of the type having an axially extending tie rod, and in which the clamp is provided with a notched contour adapted to fit over tie rods of different sizes, and in which the clamp is also provided with a hook profile which adapts the clamp to be easily moved to any desired adjusted position along the tie rod and to be tightened into engagement with the tie rod and with the outer surface of the fluid cylinder.

In the achievement of these objectives there is provided in accordance with the invention a mounting arrangement for supporting a proximity sensing means such as a proximity switch contiguous the outer peripheral surface of a fluid power cylinder, in which said fluid power cylinder is of the type comprising a cylinder body and a piston axially movable in said cylinder body, and in which the fluid power cylinder includes a pair of oppositely disposed end closure members respectively positioned at each of the respective opposite ends of said cylinder body and tie rod means connecting the oppositely disposed end closure members. The mounting arrangement comprises a sensing means support device adapted to be detachably mounted on the fluid power cylinder, the sensing means support device comprising a clamp member for detachable connection to the tie rod means. The clamp member is provided with a notched contour adapted to fit over tie rods of different diameters, and the clamp member is also provided with a hook profile which adapts the clamp member to be easily moved to any desired adjusted position along the tie rod and to be tightened into engagement with the tie rod and with the outer surface of the fluid cylinder. A swivel member is pivotally connected to the clamp member. The swivel member is positionable in overlying relation to a portion of the outer peripheral surface of the cylinder body when the sensing means support device is mounted on the fluid power cylinder. The swivel member is adapted to support a sensing device such as a reed type proximity switch contiguous the outer peripheral surface of the cylinder body, the swivel member being pivotally adjustable about its pivotal connection to the clamp member to permit the swivel member and the sensing device carried thereby to be used with fluid cylinders of different outer diameters.

Further objects and advantages of the invention will become apparent from the following specification taken in conjunction with the accompanying drawings in which:

DESCRIPTION OF THE PREFERRED EMBODIMENT

Figure 1:
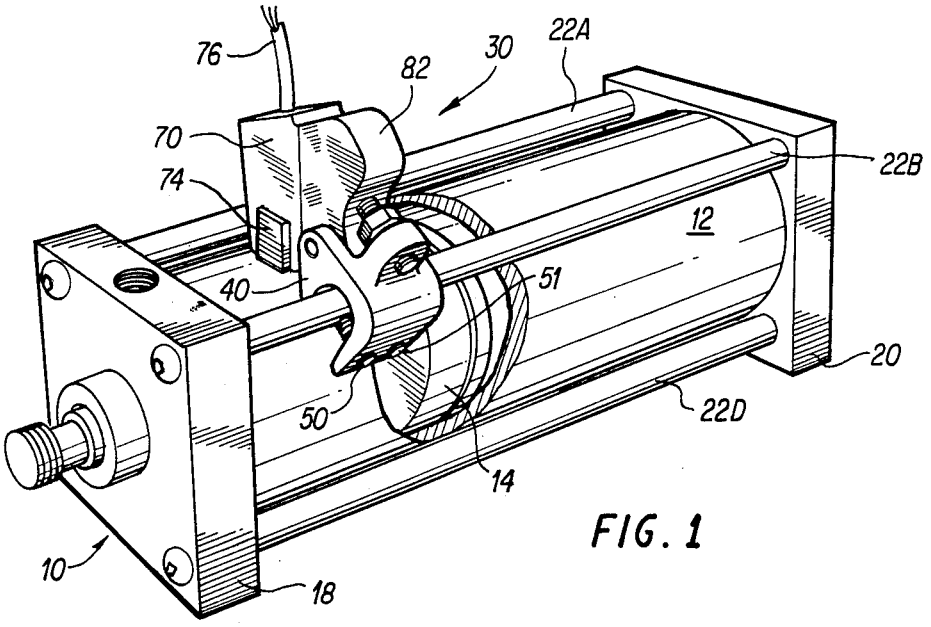
FIG. 1 is a perspective view, partially broken away, of a fluid operated cylinder having a mounting means for a proximity sensing device or switch in accordance with the invention mounted thereon.
Figure 2:
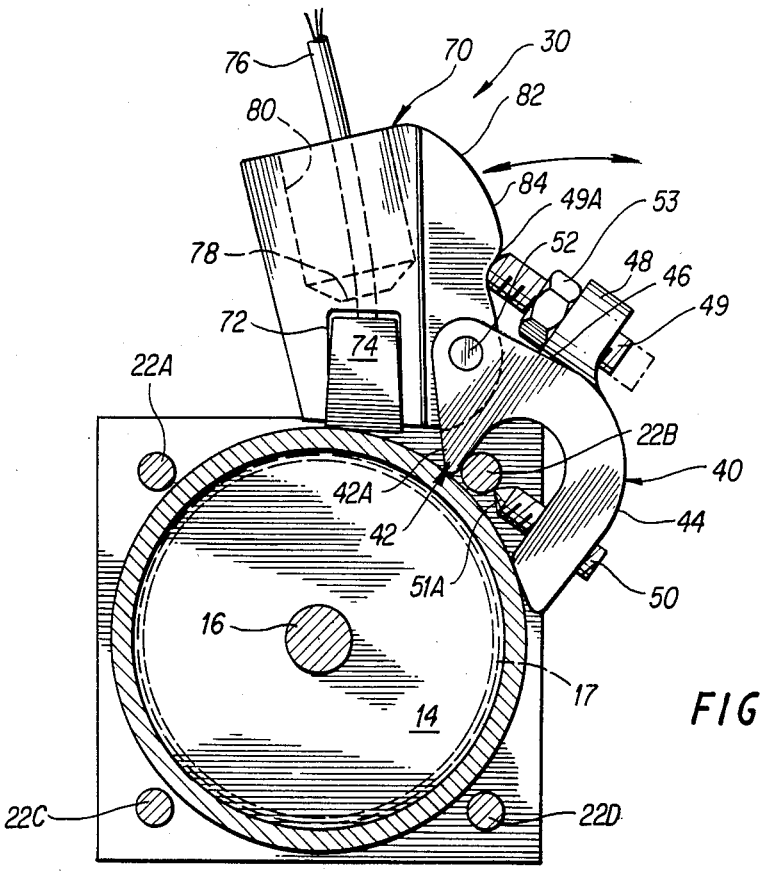
FIG. 2 is a view in transverse section of the apparatus shown in FIG. 1.

Referring now to the drawings and more particularly to FIGS. 1 and 2, there is shown in fluid power cylinder (linear actuator) generally indicated at 10 which may be either air-operated or hydraulically operated.

Fluid power cylinders of the general type indicated at 10 are well known per se and are of the general type shown, for example, by U.S. Pat. Nos. 3,639,868—Gasper et al; 4,071,725—Smith et al; 4,086,456—Bone; and 4,230,023—Ward. Thus, fluid power cylinder 10 includes a hollow cylinder body 12 within which a cylindrical piston 14 is mounted for reciprocating axial movement. Cylinder body 12 and piston 14 are both made of a non-magnetic material such as aluminum.

The ends of cylinder body 12 are closed by oppositely disposed end closure members 18 and 20, respectively, which together with suitable seals (not shown) seal opposite ends of cylinder body 12 to form a fluid-tight housing. End closure members 18 and 20 are securely held in place by a plurality of metal tie rods including a pair of oppositely disposed upper tie rods 22A, 22B, and a pair of oppositely disposed lower tie rods 22C, 22D.

Piston 14 is connected to a piston rod 16 which extends outwardly through a passage in end closure 18 for connection to an apparatus to be powered by the fluid cylinder. In the broken-away perspective view of FIG. 1, in order to simplify the drawing, the connection of piston rod 16 to piston 14 has not been shown. Piston rod 16 and end closure members 18, 20 may be made of steel.

The radially outer cylindrical periphery of piston 14 is provided with a countersunk annular recess and a permanent magnet 17 in the form of an annular band is suitably positioned in the countersunk peripheral recess of the piston. Permanent magnet 17 cooperates with the proximity sensing device as will be described in more detail, to indicate the presence of piston 14 contiguous the proximity sensing device, and to cause the closure of a proximity switch when magnet 17 carried by piston 14 is contiguous the proximity switch.

In accordance with the invention, there is provided a universal swivel clamp and switch support device generally indicated in its entirety at 30 for mounting a reed switch sensing device on the fluid cylinder. For brevity, the universal swivel clamp and switch support device will hereinafter be referred to as "switch support device" 30.

Switch support device 30 comprises a clamp member generally indicated at 40 which is adapted to be detachably secured to a tie rod such as the tie rod 22B of FIGS. 1 and 2, for example. Switch support device 30 also includes a swivel member generally indicated at 70 which is pivotally connected to clamp member 40, whereby to permit pivotal adjustment of swivel member 70 relative to clamp member 40, and thus whereby to permit adjustment of swivel member 70 and of the reed switch carried thereby to cylinders of different outer diameters, as will be explained in more detail hereinafter.

Switch support device 30, including clamp member 40 and swivel member 70, is made of a nonmagnetic material.

Clamp member 40 is of generally U-shape as seen in the transverse sectional view of FIG. 2 and comprises a bifurcated inner clamp portion 42 which lies inwardly of tie rod 22B as seen in FIGS. 1 and 2, and which includes a pair of hook-like leg portions 42A and 42B which are spaced from each other axially of fluid cylinder 10 when switch support 30 is mounted on tie rod 22B as seen in FIGS. 1 and 2.

Clamp member 40 also includes a laterally outer leg 44 which is not bifurcated and which lies laterally outwardly of and to the right of the bifurcated inner clamp portion 42 and also laterally outwardly of and to the right of tie rod 22B as viewed in FIG. 2. Clamp member 40 also includes a bridging portion 46 which connects bifurcated inner clamp portion 42 to outer leg 44.

At the right-hand portion thereof, as viewed in FIG. 2, swivel member 70 is provided with a centrally located shoulder 82 which is so dimensioned as to be received between the two bifurcated portions 42A and 42B of clamp member 40.

Swivel member 70 is mounted for pivotal movement relative to clamp member 40 by means of a suitable pivotal connection, such as roll pin 52 which is supported by the spaced hook-like leg portions 42A and 42B of clamp member 40 and which also extends through swivel 70, whereby swivel 70 may pivotally move relative to clamp 40 to a required pivotally adjusted position as required for fluid power cylinders of different outer diameters. Two different pivotally adjusted positions of swivel member 70 can be seen by comparing the positions of swivel member 70 in FIGS. 2 and 3 for fluid cylinders of different diameters.

Clamp member 40 also includes on the upper portion thereof as viewed in FIG. 2 an upstanding ring-like socket member 48 which is internally threaded to receive setscrew member 49 which is engageable with the cam-like contoured surface 84 of swivel member 70. Setscrew 49 has an oval point 49A. Also, outer leg 44 of clamp member 40 is provided with threaded passages which receive setscrews 50 and 51 therein which may be tightened into engagement with tie rod 22B. The respective setscrews 50, 51 each respectively has a cone point such as the cone point 51A shown in FIG. 2.

Swivel member 70 is provided at the lower end thereof with an upwardly open cavity 72 which is adapted to receive the encapsulated reed switch 74. A cable member 76 extends from the encapsulated reed switch 74 upwardly through an opening or passage 78 in the lower end of an internally threaded cavity 80 carried by swivel member 70. Cable member 76 is connected to suitable electrical circuitry externally of fluid motor 10. Under certain circumstances, cavity 80 may receive an electrical fitting (not shown).

Figure 4:
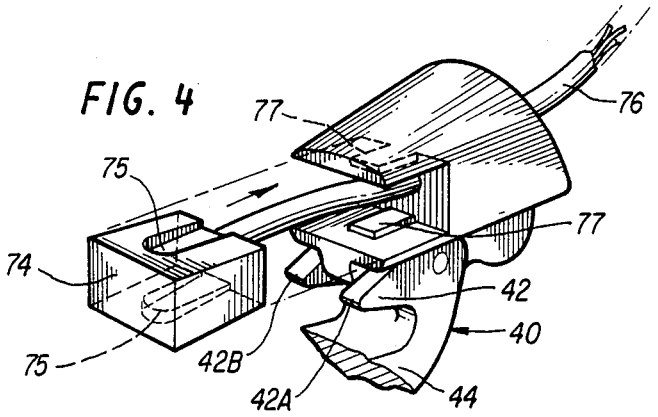
FIG. 4 is a fragmentary exploded view showing details of the mounting device for the proximity sensing device or sensing switch and of the sensing device itself.

As best seen in FIG. 4 of the drawings, the upwardly open cavity 72 of swivel member 70 is provided with projections 77 on the opposite inside wall surfaces thereof which are adapted to engage and interlock with grooves 75 carried by the opposite walls of the encapsulated switch 74, whereby to interlockingly engage encapsulated switch 74 with the cavity 72 of swivel member 70.

The cam-like contoured right-hand surface 84 of the shoulder portion 82 of swivel 70 is adapted to be engaged by the oval point 49A of set screw member 49, as best seen in the view of FIG. 2. Setscrew 49 is adjustable in threaded socket 48 to hold the pivotally adjustable swivel 70 in a position such as that shown in FIG. 2 in which switch capsule 74 is maintained in tangential contact with the outer surface of cylinder body 12.

Reed switch 74 is well known per se and consists of two overlapping ferromagnetic blades which are hermetically sealed inside a glass tube or housing, with a small air gap being left between the two switch blades. Since the reeds are magnetic, they will assume opposite polarity and be attracted to each other when influenced by a magnetic field. Sufficient magnetic flux density will cause the reeds to flex and contact each other. When the magnetic field is removed, the reeds will again spring apart to their normally open position relative to each other. Reed switches are shown, for example, by U.S. Pat. Nos. 2,187,115—Ellwood et al; 2,870,287—Corbitt et al; 2,927,178—Nitsch; and 3,310,863—Ellwood et al.

METHOD OF MOUNTING SWITCH SUPPORT DEVICE

In order to mount the switch support device generally indicated at 30 and switch 74 carried thereby on a fluid cylinder such as that indicated at 10 in FIGS. 1 and 2, for example, and assuming that clamp member 40 and swivel member 70 are already connected together for pivotal movement relative to each other by means of roll pin 52, the following procedural steps should be followed to mount the switch support device 30 and reed switch 74 carried thereby onto a fluid cylinder such as an air cylinder:

(1) Switch cable 76 is passed upwardly through aperture 78 of the cavity 80 of swivel member 70, as best seen in the view of FIG. 2.

(2) Clamp 40 and swivel 70 are oriented with respect to cylinder 10 so that set screws 50, 51 carried by clamp leg 44 are located on the side of cylinder 10 which is most convenient.

(3) The encapsulated switch 74 is slid into the upwardly open cavity 72 of swivel member 70 in such manner as to cause grooves 75 carried by the opposite walls of the encapsulated switch 74 to interlock with the corresponding projections 77 carried by the opposite inside wall surfaces of cavity 72 of swivel member 70.

(4) The hook ends of bifurcated clamp portions 42A and 42B are hooked over tie rod 22B, as seen in FIGS. 1 and 2 and set screws 50, 51 are tightened to firmly contact the under side of tie rod 22B. Tightening of setscrews 50, 51 as just described causes a reaction which pushes the bifurcated hook portions 42A, 42B against the outside surface of cylinder body 12 to thereby securely hold switch support device 30 and switch 74 carried thereby in place with respect to cylinder 10.

If it is desired to adjust the axial position of switch support device 30 and switch 74 to a different location along cylinder body 12, screws 50, 51 may be loosened to permit switch support device 30 to be adjusted to a desired position along tie rod 22B.

(5) When switch support device 30 has been located at the desired position along tie rod 22B and with respect to cylinder body 12, the device 30 may be locked in place by tightening set screws 50, 51 as previously explained.

(6) With switch 74 tangentially contacting the outer surface of cylinder body 12, as seen in FIGS. 1 and 2, swivel member 70 and hence switch 74 carried thereby may be locked in place by tightening set screw 49 against the contoured or cam-like surface 84 of swivel member 70. A lock nut 53 (FIG. 2) is tightened on set screw 49 to hold screw 49 in a given adjusted position in which it holds swivel member 70 at the position shown in FIGS. 1 and 2 in which switch 74 is in tangential contact with the outer surface of cylinder body 12.

Use of Switch Support Device and Switch on Larger Fluid Cylinder

Figure 3:
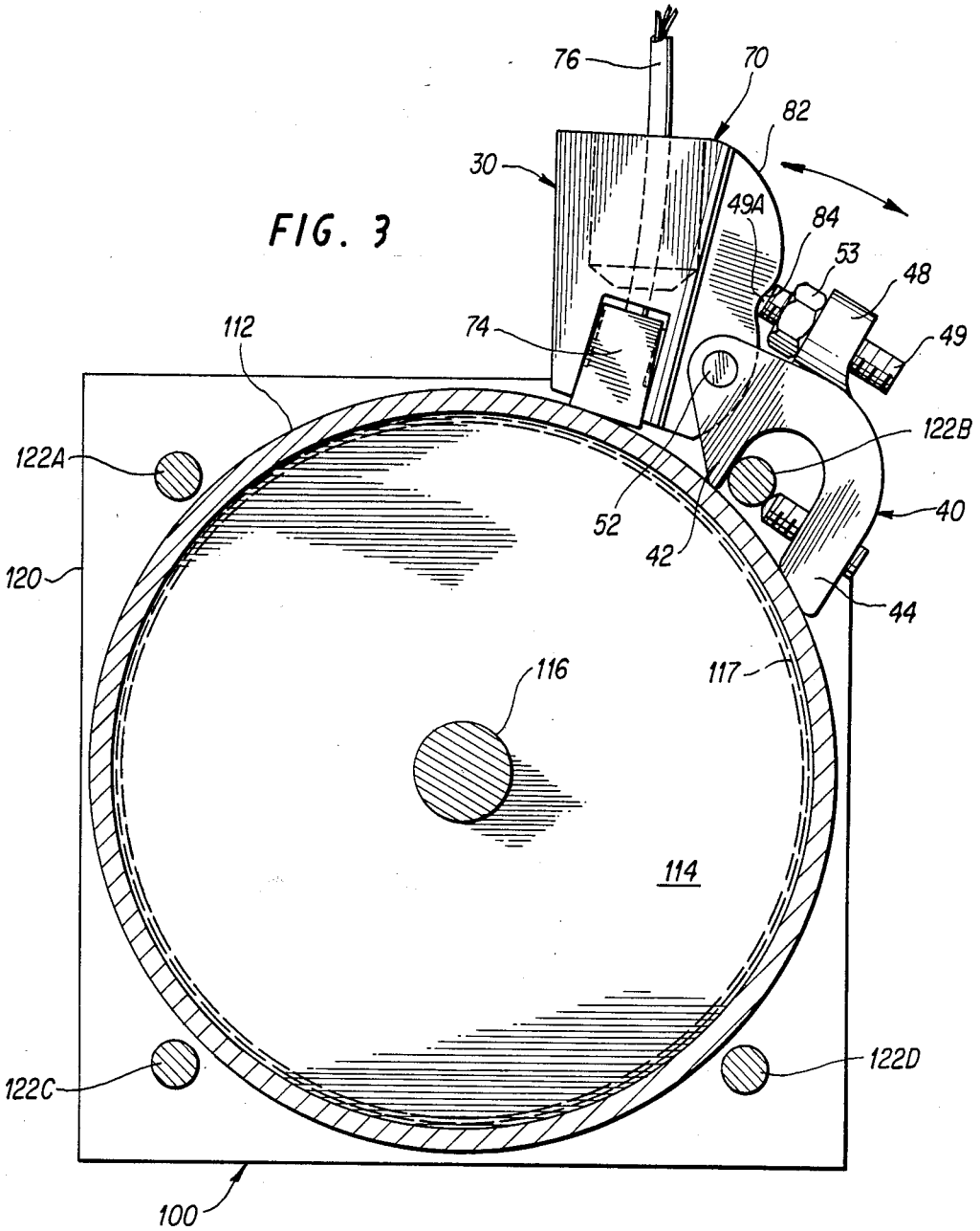
FIG. 3 is an enlarged view in transverse section similar to the view of FIG. 2 showing the same mounting means as that shown in FIGS. 1 and 2 but mounted on a tie rod of larger diameter than that of FIGS. 1 and 2, and supporting a sensing device in engagement with a cylinder of larger diameter than that of FIGS. 1 and 2.

Referring now to FIG. 3, the same switch support device 30 as that described in connection with FIGS. 1 and 2 is shown mounted on a fluid cylinder generally indicated at 100. Fluid cylinder 100 in FIG. 3 is generally similar to the cylinder 10 of FIGS. 1 and 2 but is of larger dimensions, and includes a cylinder body 112 having a substantially larger diameter than cylinder body 12 of cylinder 10.

Cylinder 100 of FIG. 3 has a pair of oppositely disposed end closure members at the opposite axial ends of cylinder body 112, one of which, end closure 120, is shown in FIG. 3. Cylinder body 112 is of non-magnetic material. Four tie rods, respectively indicated at 122A, 122B, 122C, and 122D connect the oppositely disposed end closure members of fluid cylinder 100, in the same manner as in the embodiment of FIGS. 1 and 2.

In the embodiment of FIG. 3, the diameter of tie rods 122A–122D, inclusive, is greater than the diameter of the tie rods of FIGS. 1 and 2.

A piston member 114 of non-magnetic material having a piston rod 116 connected thereto is positioned for axially reciprocating movement in cylinder body 112, in the same manner as in the embodiment of FIGS. 1 and 2. A permanent magnet 117 in the form of an annular band is suitably positioned in a countersunk peripheral recess of piston member 114, all in a manner similar to that of the embodiment of FIGS. 1 and 2.

Since the switch support device 30 of FIG. 3 is identical with that of FIGS. 1 and 2, switch support device 30 will not be described in detail again. However, it will be noted that in the embodiment of FIG. 3, swivel member 70 is tilted in a clockwise direction as viewed in FIG. 3, as compared to the pivotal position of swivel member 70 relative to clamp 40 in the embodiment of FIGS. 1 and 2. Thus, FIG. 3 shows that when the switch support device 30 is used with a larger diameter fluid cylinder, the pivotal mounting arrangement of the swivel member 70 relative to clamp 40 permits swivel member 70 to articulate or pivot relative to clamp 40, whereby to accommodate switch 74 to the larger diameter cylinder.

In the position of FIG. 3, clamp member 40 is engaged with tie rod 122B by tightening screws 50, 51 in the same manner as described in the arrangement of FIGS. 1 and 2, and swivel member 70 is held in the position of FIG. 3 in which it holds switch member 74 tangentially against the outer surface of the larger diameter cylinder body 112 due to the engagement of screw member 49 with the contoured or cam-like surface 84 of swivel member 70. The lock nut 43 is tightened as seen in FIG. 3 to hold screw 49 in the adjusted position shown in FIG. 3.

It should be noted that in both of the views shown in FIGS. 2 and 3, the U-shaped or notched construction of clamp member 40 permits the clamp member to fit over cylinder tie rods of various diameters. Also, the bifurcated hook-like clamp portions 42A, 42B serve to hook clamp 40 over the tie rod and also cause the clamp to be firmly engaged with the outer surface of fluid cylinder body 12 or 112 when set screws 50, 51 are tightened against the tie rod such as tie rod 22B or 122B.

The adjustable mounting arrangement described hereinbefore permits the proximity switch or switches to be located anywhere within range of travel of the piston. Also, several switches may be mounted on the cylinder to control any desired sequence function.

While there has been shown and described a particular embodiment of the invention, it will be obvious to those skilled in the art that various changes and modifications may be made therein without departing from the invention and, therefore, it is aimed to cover all such changes and modifications as fall within the true spirit and scope of the invention.

The embodiments of the invention in which an exclusive property or privilege is claimed are defined as follows:

1. A mounting arrangement for supporting a proximity sensing means contiguous the outer peripheral surface of a fluid power cylinder, in which said fluid power cylinder is of the type comprising a cylinder body and a piston axially movable in said cylinder body, and in which said fluid power cylinder includes a pair of oppositely disposed end closures respectively positioned at each of the respective opposite ends of said cylinder body, and tie rod means connecting said oppositely disposed end closures, said mounting arrangement comprising a sensing means support device adapted to be detachably mounted on said fluid power cylinder including a clamp member for detachable connection to said tie rod means and a swivel member, means pivotally connecting said swivel member to said clamp member, whereby said swivel member is pivotally adjustable relative to said clamp member for cylinders of different outer diameters, said swivel member being positionable in overlying relation to a portion of the outer peripheral surface of said cylinder body when said sensing means support device is mounted on said fluid power cylinder, said swivel member being adapted to support a sensing device contiguous said outer peripheral surface of said cylinder body.

2. A mounting arrangement as defined in claim 1 comprising a proximity sensing means mounted on said swivel member.

3. A mounting arrangement as defined in claim 2 in which said proximity sensing means is responsive to the presence of a magnetic field.

4. A mounting arrangement as defined in claim 3 in which said sensing means is a reed switch having ferromagnetic reeds which are movable relative to each other in the presence of a magnetic field of a predetermined strength, whereby to perform a switching operation.

5. A mounting arrangement as defined in claim 1 in which said swivel member is provided with a cavity which opens inwardly from a surface of said swivel member which faces said outer peripheral surface of said cylinder body when said sensing means support device is mounted on said fluid power cylinder, and said sensing means is adapted to be positioned in said cavity.

6. A mounting arrangement as defined in claim 5 in which said sensing means and said cavity are provided with cooperating interlocking means whereby to interlockingly engage said sensing means with said cavity, and thus whereby to secure said sensing means in said cavity of said swivel member.

7. A mounting arrangement as defined in claim 3 in which said proximity sensing means is responsive to a magnet means carried by said piston.

8. A mounting arrangement as defined in claim 1 in which said clamp member is of generally U-shape and includes a first leg adapted to lie between a given tie rod of said fluid power cylinder and the cylinder body of said fluid power cylinder, and a second leg which lies outwardly of said given tie rod, said clamp member including a bridging clamp portion connecting said first leg and said second leg, and means carried by said second leg for tightening said clamp against said given tie rod.

9. A mounting arrangement as defined in claim 8 in which said means carried by said second leg for tightening said clamp against said given tie rod is a set screw means.

10. A mounting arrangement as defined in claim 8 in which said first leg is provided with a hook profile with is adapted to bear against said tie rod, and which adapts said clamp member to be easily moved to any desired adjusted position along said tie rod and to be tightened into engagement with said tie rod and with the outer surface of said fluid cylinder.

11. A mounting arrangement as defined in claim 1 including means carried by said clamp member and adapted to engage said swivel member to hold said swivel member in a position in which said sensing means is maintained in contact with the outer surface of the cylinder body.

12. A mounting arrangement as defined in claim 11 in which said means carried by said clamp member is an adjustable setscrew which is engageable with a surface of said swivel member.

13. A mounting arrangement for supporting a proximity sensing means contiguous the outer peripheral surface of a fluid power cylinder, in which said fluid power cylinder is of the type comprising a cylinder body and a piston axially movable in said cylinder body, and in which said piston carries a magnet, said fluid power cylinder including a pair of oppositely disposed end closures respectively positioned at each of the respective opposite ends of said cylinder body, and tie rod means connecting said oppositely disposed end closures, said mounting arrangement comprising a sensing means support device adapted to be detachably mounted on said fluid power cylinder including a clamp member for detachable connection to said tie rod means and a swivel member, means pivotally connecting said swivel member to said clamp member, whereby said swivel member is pivotally adjustable relative to said clamp member for cylinders of different outer diameters, said swivel member being positionable in overlying relation to a portion of the outer peripheral surface of said cylinder body when said sensing means support device is mounted on said fluid power cylinder, said swivel member being provided with a cavity which opens inwardly from a surface of said swivel member which faces said outer peripheral surface of said cylinder body when said sensing means support device is mounted on said fluid power cylinder, said cavity of said swivel member being adapted to receive a sensing means comprising a reed switch having ferromagnetic reeds which are movable relative to each other due to the proximity of said magnet carried by said piston whereby to perform a switching operation.

14. A mounting arrangement as defined in claim 13 in which said reed switch and said cavity are provided with cooperating interlocking means whereby to interlockingly engage said reed switch with said cavity, and thus whereby to secure said reed switch in said cavity of said swivel member.

15. A mounting arrangement as defined in claim 13 in which said clamp member is of generally U-shape and includes a first leg adapted to lie between a given tie rod of said fluid power cylinder and the cylinder body of said fluid power cylinder, and a second leg which lies outwardly of said given tie rod, said clamp member including a bridging clamp portion connecting said first leg and said second leg, and means carried by said second leg for tightening said clamp against said given tie rod.

16. A mounting arrangement as defined in claim 15 in which said means carried by said second leg for tightening said clamp against said given tie rod is a set screw means.

17. A mounting arrangement as defined in claim 15 in which said first leg is provided with a hook profile which is adapted to bear against said tie rod, and which adapts said clamp member to be easily moved to any desired adjusted position along said tie rod and to be tightened into engagement with said tie rod and with the outer surface of said fluid cylinder.

18. A mounting arrangement as defined in claim 13 including means carried by said clamp member and adapted to engage said swivel member to hold said swivel member in a pivotally adjusted position in which said reed switch is maintained in contact with the outer surface of the cylinder body.

19. A mounting arrangement as defined in claim 18 in which said means carried by said clamp member is an adjustable set screw which is engageable with a surface of said swivel member.

* * * * *